US005143043A

United States Patent [19]

Brelsford

[11] Patent Number: 5,143,043

[45] Date of Patent: Sep. 1, 1992

[54] ARROW POINT GUARD

[76] Inventor: Harry W. Brelsford, 233 E. Carrillo St., Ste. C, Santa Barbara, Calif. 93101-2187

[21] Appl. No.: 655,766

[22] Filed: Feb. 14, 1991

[51] Int. Cl.[5] ..... F41B 5/00

[52] U.S. Cl. ..... 124/24.1; 124/44.5; 124/88

[58] Field of Search ..... 124/24.1, 44.5, 86, 124/88

[56] References Cited

U.S. PATENT DOCUMENTS

| | | | |
|---|---|---|---|
| 2,483,928 | 10/1949 | Ott | 124/24.1 X |
| 2,691,974 | 10/1954 | Nelson | 124/24.1 X |
| 3,153,406 | 10/1964 | Pemble | 124/44.5 X |
| 3,518,959 | 7/1970 | Bunker | 124/44.5 X |
| 4,577,612 | 3/1985 | Zell | 124/24.1 X |
| 4,685,439 | 8/1987 | Cosentino, Jr. | 124/44.5 |
| 4,974,575 | 12/1990 | Mitchell | 124/88 |

FOREIGN PATENT DOCUMENTS

| | | | |
|---|---|---|---|
| 1374032 | 2/1988 | U.S.S.R. | 124/88 |

*Primary Examiner*—Randolph A. Reese
*Assistant Examiner*—Jeffrey L. Thompson

[57] ABSTRACT

Projecting forwardly from a bow 10 is a rod 18 having a transverse arm 19 rotatable on the rod. A cup or receptacle 20 is adjustably mounted on the arm to receive the head or point 21 of a nocked arrow 22. An adjustable stop 31 on the outer end of the rod holds the arrow point in a position causing the bow string 13 to be angled. This pressure on the arrow 22 and arm base 23 holds the arm to any selected position, preferably one that disposes the arrow on or near the arrow rest 17. When the archer draws the arrow for shooting, the arm rotates out of the path 25 of the arrow.

10 Claims, 2 Drawing Sheets

ARROW POINT GUARD

This invention relates to archery bows and has particular reference to a guard for a nocked arrow, especially a broad head arrow, to protect persons from injury.

BACKGROUND OF THE INVENTION

Hunting archers invariably nock an arrow in the bowstring so that an arrow may be quickly shot if game is encountered. This bow and arrow combination is manually carried frequently for hours and often for the better part of the day. The archer holds the arrow with his fingers on the arrow rest of the bow, and this grip on the bow and arrow becomes tiring.

The broad heads of hunting arrows are usually constructed of tapered razor-sharp blades, and any accidental stumble or fall might severely injure the archer or his companion. It is highly desirable, therefore, to protect the broad head to prevent such injuries. One attempt in the prior art to protect or guard the broad head is to provide a boot over the broad head that is held to the bow by a cord or string. However, when the archer bends the bow for a shot, the boot may stay over the broad head, defeating the shot.

I have devised a guard that is positive in its release from the broad head and avoids the drawbacks of this boot and cord structure.

BRIEF DESCRIPTION OF THE INVENTION

Bows presently on the market are provided with an internally threaded insert so that a stabilizer rod may be screwed into this insert. I provide a long threaded rod having one end screwed into this stabilizer insert and having a transverse arm on the outer end of the rod. This arm is rotatable on the rod. Disposed on the outer end of the arm is a cup or receptacle that covers the broadhead. The arm may be adjusted to an angle that properly positions a nocked arrow on the arrow rest of the bow, eliminating the need for the archer to hold the arrow on the rest with his fingers. Upon drawing the arrow for a shot, the arm and its cup swing out of the path of the arrow. If a stabilizer is desired, the rod may be made of heavy material, thus providing a combined stabilizer and broad head guard. The guard is also useful for arrows having target points.

DESCRIPTION OF THE DRAWINGS

In the drawings forming an integral part of this specification.

DETAILED DESCRIPTION

Figure 1:
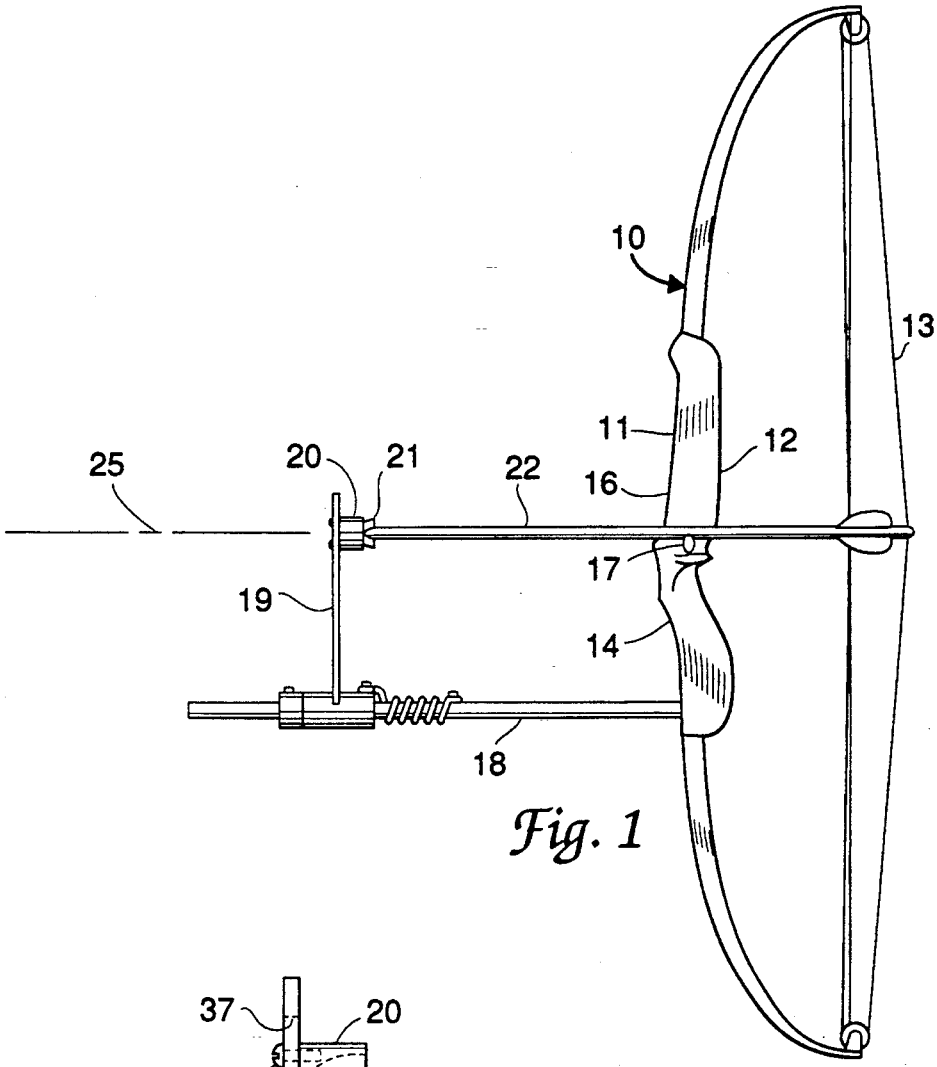
FIG. 1 is an elevation view of a bow having a rod screwed into the stabilizer thread insert and having a transverse arm holding an arrow head so that the arrow is substantially on the shooting path of the arrow.

Referring to FIG. 1, a bow 10 has a forward side 11 and rear side 12 and a bow string 13. The bow 10 has a handgrip portion 14, and above this is a riser section 16 having an arrow rest 17. Projecting forwardly of the bow 10 is a horizontal rod 18 having a rotatable transverse arm 19. At the outer end of the arm 19 is a cup or receptacle 20 in which is disposed a broad head 21 of an arrow 22 nocked into the bow string 13. The bow string 13 is pulled to the right in FIG. 1, which creates a compressive force on the arrow 22. This compressive force acts on the arm 19 to hold the arm 19 in any selected angular position on the rod 18. The bow 10 is preferably provided with an internally threaded stabilizer insert (not shown) into which the rod 18 is threaded. However, the rod 18 may be secured to the bow in any satisfactory manner.

Figure 2:
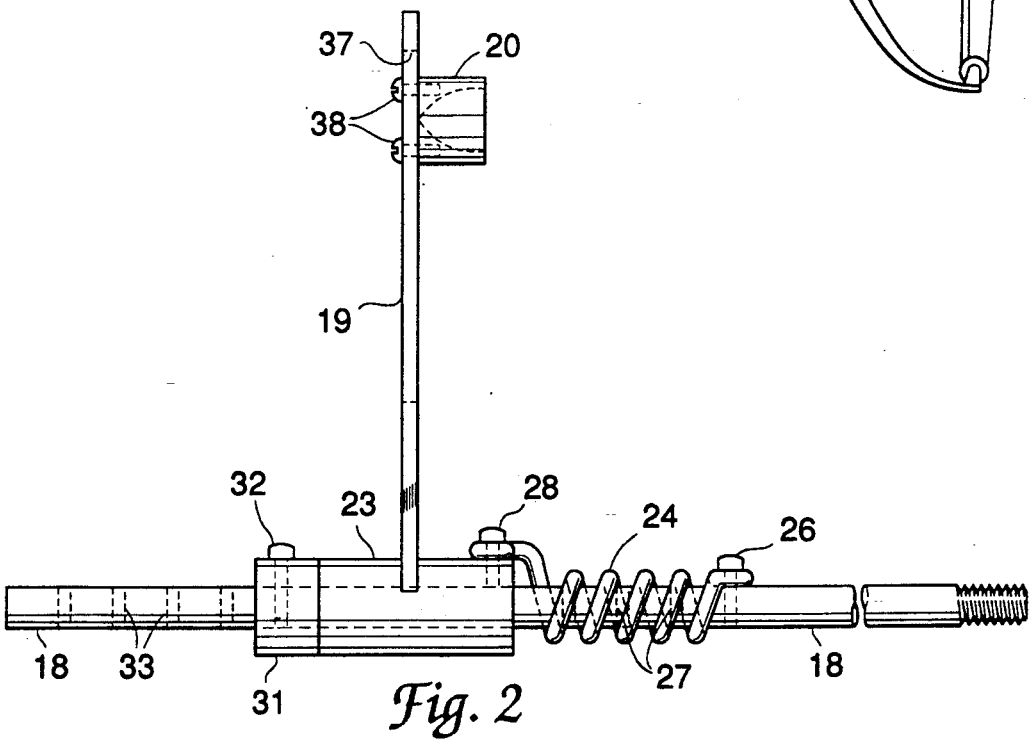
FIG. 2 is an enlarged view of the presently preferred rod and arm of FIG. 1.
Figure 3:
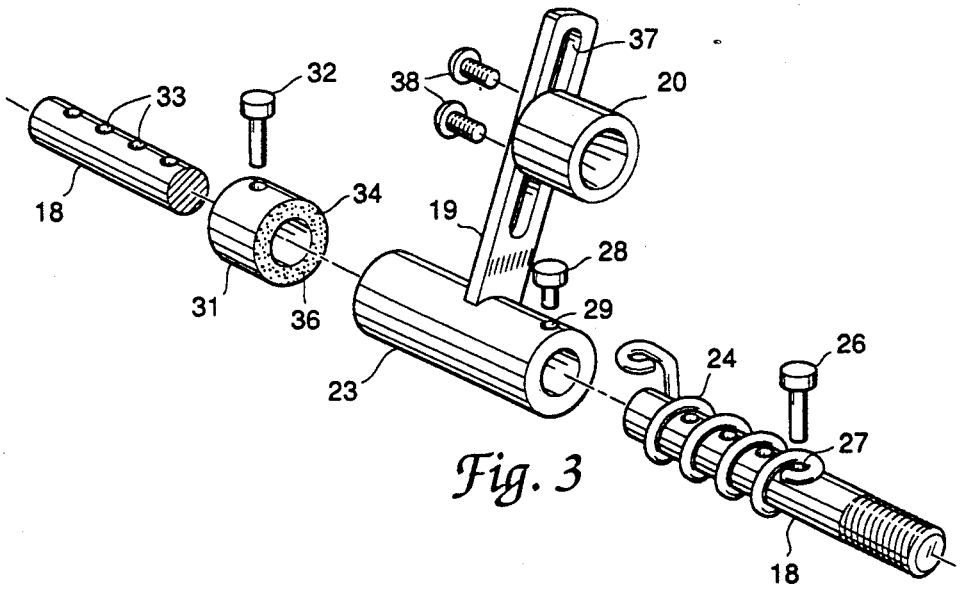
FIG. 3 is an exploded view of the structure of FIG. 2 with a section of the rod removed.

Referring now to FIGS. 2 and 3, the arm 19 is mounted on a tubular base 23 that is rotatable on the rod 18. It is limited from free rotation by a coil spring 24 having one end secured to the rod 18 by means of a pin 26 tightly fitting into one of a series of holes 27 in the rod 18. The other end of the spring 24 is secured to the arm base 23 by a pin 28 fitting tightly into a hole 29 in the base 23. The spring 24 is a tension spring urging the base 23 and its arm 19 to the right in FIGS. 2 and 3. However, it is weaker than the compressive force on the arrow 22 caused by the bow string 13 being partly drawn. When, however, the arrow 22 of FIG. 1 is drawn to the right, the spring 24 pulls the base 23 and its arm 19 to the right.

The spring 24 is also a torsion spring that rotates the transverse arm 19 to the right or left as desired when the arrow is withdrawn from the receptacle 20. This moves the arm 19 out of the shooting path 25 of arrow 22 (FIG. 1). The arm 19 swings to the right as viewed in FIG. 3 and to the shooter's right as viewed in FIG. 4.

Referring still to FIGS. 2 and 3, mounted on the left end of the rod 18 is a collar 31, which is adjustably located on the rod by 18 by means of a pin 32 tightly fitting into one of a series of holes 33 on the rod 18. This adjustment of the position of collar 31 on the rod accommodates arrows of varying length.

The collar 31 has a right face 34 made of imbedded grits 36 that grip the left end of the tubular base 23 and prevent the base 23 from rotating when the base 23 is pressed against the collar 31 when it is forced against the face 34 by the compression force on the arrow 22 (FIG. 1). The tubular base 23 may be made of any material softer than the grits 36, for example, soft metal or plastic, when the grits are formed of sintered metal, or hard mineral, preferably of the coarseness of medium sandpaper. The gritted surface and the adjoining face of 23 act as a clutch.

It will be appreciated that in the absence of spring 24 the arm 19 might rotate on rod 18 by force of gravity, or sidewise motion of the bow by the archer when the arrow is withdrawn from the receptacle 20. I prefer, however, to make this rotation positive so that the arm and receptacle will be reliably removed from the arrow flight path 25.

Referring to FIGS. 2 and 3, the lever arm 19 is provided with lengthwise adjustment for the position of receptacle 20, and this may take any desired form, such as a slot 37 through which screws 38 pass to thread into the receptacle 20.

Figure 4:
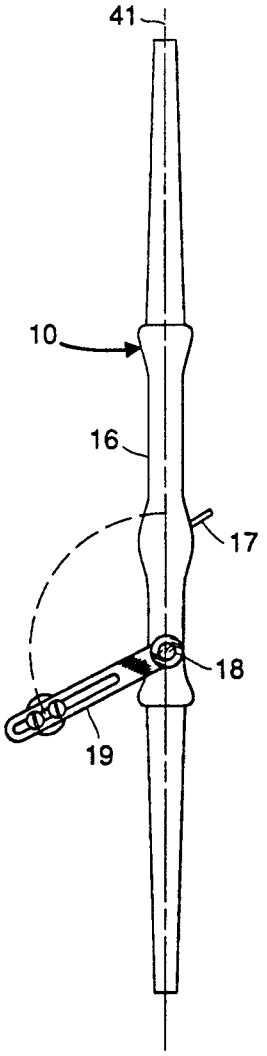
FIG. 4 is a front view of the bow of FIG. 1 showing the transverse arm rotated out of the path of the arrow.
Figure 5:
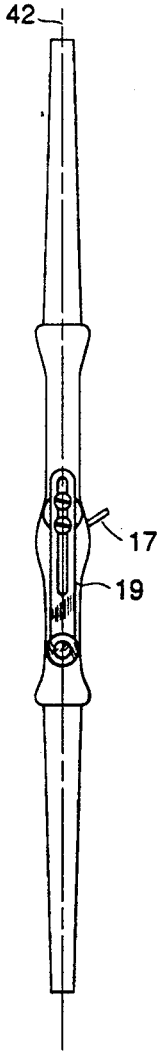
FIG. 5 is a front view of the rod and arm when it is holding an arrow on the arrow rest of the bow.

Referring now to FIG. 4, the arm 19 is shown in its rotated position after the arrow is withdrawn from the receptacle 20 or after the arrow is shot from the arrow rest 17. The bow 10 has a lengthwise axis 41, and in FIG. 4 the transverse arm 19 has rotated well out of the path of any arrow disposed on the arrow rest 17. Shown in FIG. 5 is the operating position of arm 19 when it is holding the arrow 22 (FIG. 1). The lever has a lengthwise axis 42, and these two axes 41 and 42 may be parallel or slightly at any angle, depending on whether the rod 18 is located exactly below the junction of the arrow rest 17 and riser 16. The entire arm is adjustable to any desired placement of the arrow on the bow, whether above or below the arrow rest or away from the riser 16 or pressing the arrow against the riser 16.

Figure 6:
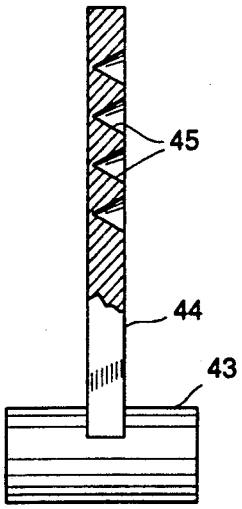
FIG. 6 is an elevation view, partly in section of a modified arm wherein recesses or sockets are provided for arrow points instead of cups or receptacles.

Illustrated in FIG. 6 is a modification wherein only the points of arrows are protected. Secured to a tubular base 43 is a transverse arm 44 having a series of longitudinally spaced conical recesses 45. This spacing of recesses 45 is an adjustment for the positioning of any arrow. The major safety factor for a hunting broad head on an arrow is preventing the point from penetrating a person. This is accomplished by the structure of FIG. 6, even though a person could be cut by brushing against the razor edges of the broadhead.

OPERATION

The user of a bow ordinarily uses arrows of the same length, and once the system is adjusted to the arrow length, there is no need to readjust it. Referring to FIG. 2, the user removes pins 32 and 26 so that the arm 19 and spring 24 may freely slide on the rod 18. The user then grasps the bow in one hand, places arrow 22 on the arrow rest 17, and nocks the arrow on the bowstring 13 as shown in FIG. 1. This fixes the position of the arrow 22, and the user then rotates the arm 19 to an upright position and moves the arm 19 to the right in FIG. 1 until the arrow point 21 bottoms on the receptacle 20. The user then pulls the arm 19 further to the right until the bowstring 13 is angled, placing a compression load on the arrow 22. When the desired amount of compression is achieved, the user notes the position of the collar 31 on the rod 18 and inserts pin 32 in the proper hole 33 in the rod 18. The grits 36 on collar face 34 then hold the assembly of arm 19, arrow 22, and bow 10. The user next rotates the right end of spring 24 to place an angular or torsion load on the base 23 of the arm 19. The right end of the spring 24 is then manually pulled to the right until a tension load is also added to spring 24. The pin 26 is then inserted in the proper hole 27 to maintain this torsion and tension load on spring 24.

The assembly is now ready for use and the archer is free to carry the bow with any desired grip without the necessity of manually holding the arrow with his fingers. The arrow head 21 (FIG. 1) is now fully protected, and, if the user stumbles or otherwise inadvertently pushes the arrow point against himself or a companion, no cutting occurs. If now a target is sighted, the bowman grasps the bow string 13 and arrow 22, pulling them to the right as viewed in FIG. 1. The arrow head 21 has then been removed from the receptacle 20, and the tension in spring 24 pulls the arm base 23 to the right, free of the grits 36 (FIG. 3), and the arm 19 is free to rotate on rod 18. The torsion in spring 24 then acts on the base 23 to rotate the arm 19 out of the path 25 of the arrow, and the user can shoot the arrow with no impediment from the device.

If the arrow has been shot and protection from a new arrow is desired, the user merely nocks the new arrow and places it on the arrow rest 17. The user grasps the arm 19 and rotates it to the upright position as shown in FIG. 1. The bow string 13 is then pulled farther to the right than shown in FIG. 1 until the point of the arrow 22 clears the right edge of receptable 20 and then the bow string 13 is relaxed to allow the arrowhead to bottom in the receptable 20. The assembly is then ready for instant use, and the user removes his grip on the arm 19 and needs merely to grasp the bow. The rod, arm, and receptable hold the arrow safely in position for instant use.

The invention has been described with reference to the presently preferred embodiment as required by the patent statutes. It will be apparent to those skilled in the art that various modifications and simplication may be made. For example, pins in the rod holes 33 can be substituted for the collar 31 if the left face of base 23 has a radial notch or series of notches to hold the arms 19 at the desired angle. For any particular model of bow the receptacle 20 need not be adjustable in position on the arm 19. The spring 24 serves a dual function, and these two functions could be served by separate springs; for example, a coil spring between collar 31 and base 23. Many different structures can be used between the collar 31 and base 23 to hold the arm at a selected arm angle. Various other modifications may be made, and all such variations and modifications that fall within the true spirit and scope of the invention are included within the scope of the following claims.

I claim:

1. In combination with an arrow having a point and a bow having a forward side, a rear side, and a bow string, said arrow being nocked in the bow string and having a major portion projecting a distance forwardly of the bow, an arrow point guard for the arrow, comprising:

a) a rod secured to the bow and projecting forwardly of the bow a distance approximately that of the arrow projecting distance;

b) a transverse arm rotatably mounted on the rod;

c) and an arrow point receptacle secured to the arm to hold the point of the nocked arrow, whereby the arrow is held on the bow ready for use and rearward retraction of the arrow point from the receptacle allows said arm to rotate out of the path of the arrow.

2. The combination of claim 1 wherein the bow has a lengthwise axis and an arrow rest and there is added:

d) means for adjustably holding the arm at a selected angle to the bow axis to thereby position an arrow point so that the arrow is held close to the arrow rest of the bow.

3. The combination of claim 1 wherein there is added:

d) means for adjustably holding the arm at selected positions along the length of the rod, to thereby accommodate arrows of varying length.

4. The combination of claim 1 wherein there is added:

d) means for adjustably holding the arm at a selected angle; and e) spring means interconnecting the rod and arm to rotate the arm on the rod when the arrow is pulled rearwardly of the bow.

5. The combination of claim 1 wherein the bow has a lengthwise axis there is added:

d) means for adjustably holding the arm at a selected angle to the bow axis;

e) and means for releasing the means for adjustably holding the arm at a selected angle, operated by pulling an arrow rearwardly of the bow, so that the arm can rotate from its selected angle position.

6. The combination of claim 1 wherein the receptacle is a socket formed in the arm.

7. In combination with an arrow having a point and a bow having a forward side, a rear side, an arrow rest, and a bow string, said arrow being nocked in the bow string and having a major portion projecting a distance forwardly of the bow, an arrow point guard for the arrow comprising:

a) a rod secured to the bow and projecting forwardly of the bow a distance approximately that of the arrow projecting distance;

b) a transverse arm rotatably mounted on the rod;

c) and an arrow point receptacle secured to the arm to hold the point of the nocked arrow, characterized by said receptacle being adjustably mounted on the arm, to thereby position the arrow point so that the arrow is held close to the arrow rest of the bow, whereby the arrow is held on the bow ready for use and rearward retraction of the arrow point from the receptacle allows said arm to rotate out of the path of the arrow.

8. The combination of a bow having a bowstring, an arrow rest, a forward side, and a rear side; an arrow nocked in the bowstring and having a point, and an arrow guard, comprising:

a) a rod secured to the bow and projecting forwardly of the bow;

b) a transverse arm rotatably mounted on the rod;

c) and a cup-shaped arrow pint receptacle adjustably mounted on the arm and into which the forwardmost portion of the arrow pint is inserted whereby the point of the arrow is held to dispose the arrow close to the arrow rest of the bow.

9. The combination of claim 8 wherein the bow has a lengthwise axis and the position of the arm on the rod causes the nocked arrow to be under lengthwise compression and there is added:

d) means for adjustably holding the arm at a selected angle to the bow axis and releasing the arm to rotate on the rod when the arrow point is removed from the receptacle.

10. The combination of claim 8 wherein the position of the arm on the rod causes the nocked arrow to be under lengthwise compression and there is added:

d) means for adjustably holding the arm at a selected angular position; and e) spring means interconnecting the rod and arm to release the arm for rotation on the rod, said spring means having a weaker spring force than the lengthwise compressive force on the arrow.

* * * * *